US011635242B2

(12) United States Patent
Hsu et al.

(10) Patent No.: US 11,635,242 B2
(45) Date of Patent: Apr. 25, 2023

(54) MONITORING METHOD OF COOLING SYSTEM AND MONITORING DEVICE THEREOF

(71) Applicant: DEI ENERGY SOLUTION TECHNOLOGY CO., LTD., Kaohsiung (TW)

(72) Inventors: Te-Pin Hsu, Kaohsiung (TW); Fu-Min Li, Kaohsiung (TW); Chia-Sheng Su, Kaohsiung (TW)

(73) Assignee: DEI ENERGY SOLUTION TECHNOLOGY CO., LTD., Kaohsiung (TW)

( * ) Notice: Subject to any disclaimer, the term of this patent is extended or adjusted under 35 U.S.C. 154(b) by 314 days.

(21) Appl. No.: 17/060,387

(22) Filed: Oct. 1, 2020

(65) Prior Publication Data

US 2021/0341195 A1 Nov. 4, 2021

(30) Foreign Application Priority Data

Apr. 30, 2020 (TW) ..... 109114643

(51) Int. Cl.
*F25B 49/02* (2006.01)
*F25B 39/00* (2006.01)

(52) U.S. Cl.
CPC ..... *F25B 49/02* (2013.01); *F25B 39/00* (2013.01); *F25B 2400/21* (2013.01); *F25B 2700/2104* (2013.01); *F25B 2700/2106* (2013.01); *F25B 2700/2116* (2013.01); *F25B 2700/2117* (2013.01); *F25B 2700/21151* (2013.01); *F25B 2700/21152* (2013.01)

(58) Field of Classification Search
CPC ..... F25B 49/02; F25B 39/00; F25B 2400/21; F25B 2700/2104; F25B 2700/2106; F25B 2700/21152; F25B 2700/2166; F25B 2700/2117
See application file for complete search history.

(56) References Cited

FOREIGN PATENT DOCUMENTS

| | | | | |
|---|---|---|---|---|
| CN | 104331105 B | * | 1/2017 | |
| JP | 2018141574 A | * | 9/2018 | ..... F25B 1/00 |
| WO | WO-2011156080 A1 | * | 12/2011 | ..... G06K 9/6284 |

OTHER PUBLICATIONS

Atsushi, Composition Abnormality Detection Device and Composition Abnormality Detection Method, 2018, Full Document (Year: 2018).*

(Continued)

*Primary Examiner* — Nael N Babaa
(74) *Attorney, Agent, or Firm* — Mark M. Friedman

(57) ABSTRACT

A monitoring method of a cooling system and a monitoring device thereof are provided. The monitoring method includes the steps: establishing an abnormality determination model according to predetermined abnormal data and predetermined abnormal types using deep learning by a monitoring module; generating groups of temperature data respectively by a plurality of temperature sensors; and determining one or more abnormal types and an abnormal prediction of the cooling system according to the groups of temperature data and the plurality of temperature sensors using the abnormality determination model by the monitoring module.

8 Claims, 4 Drawing Sheets

(56) References Cited

OTHER PUBLICATIONS

Brummel, Systems and methods for learning of normal sensor signatures, condition monitoring and diagnosis, 2011, Full Document (Year: 2011).*
Liu, Thermal protection method and thermal protection device as well as apparatus with thermal protection function, 2017, Full Document (Year: 2017).*

* cited by examiner

MONITORING METHOD OF COOLING SYSTEM AND MONITORING DEVICE THEREOF

CROSS REFERENCE TO RELATED APPLICATION

This application claims the priority of Taiwan Patent Application No. 109114643, filed on Apr. 30, 2020, title "MONITORING METHOD OF COOL SYSTEM AND MONITORING DEVICE THEREOF", and the disclosure of which is incorporated herein by reference.

FIELD OF INVENTION

The present disclosure relates to a cooling system, and more particularly, to a monitoring method of the cooling system and a monitoring device thereof.

BACKGROUND OF INVENTION

A temperature monitoring mechanism of a traditional cooling system prevents pressure of a condenser from being too high or prevents compressor suction pressure from being too low by high-low pressure protection of a compressor. Because pressure is proportional to temperature, the monitoring purpose can be achieved. A high-pressure switch and a low-pressure switch are combined in a housing in a pressure switch, and two balls work therebetween. If the pressure reaches a "high" setting value, or the pressure drops to a "low" setting value, the switch works.

The disadvantage of a traditional monitoring system is that when the cooling system is abnormal or close to failure, it cannot be known in advance. When it is determined that the cooling system cannot be operated, it can only be shut down for maintenance. Because a high-low pressure gauge is connected to a copper tube of the compressor, the copper tube must be evacuated in order to cut the copper tube and remove the pressure switch for repairing the compressor.

Therefore, it is necessary to provide a monitoring method of the cooling system to solve the problems of conventional technologies.

SUMMARY OF INVENTION

To achieve the above objective, the present disclosure provides a monitoring method of a cooling system and a monitoring device thereof.

In one embodiment, the present disclosure provides an monitoring method of a cooling system, comprising steps of: S1: establishing an abnormality determination model according to predetermined abnormal data and predetermined abnormal types using deep learning by a monitoring module; S2: generating groups of temperature data by a plurality of temperature sensors; and S3: determining one or more abnormal types and an abnormal prediction of the cooling system according to the groups of temperature data and the plurality of temperature sensors using the abnormality determination model by the monitoring module.

In one embodiment, the monitoring method further includes a step of S4: reestablishing the abnormality determination model according to the groups of temperature data and said one or more abnormal types using deep learning by the monitoring module.

In one embodiment, the step of S3 further includes: generating a plurality of temperature grades respectively according to the groups of temperature data using a grade calculation formula, determining said one or more abnormal types according to the plurality of temperature grades using the abnormality determination model, and determining the abnormal prediction according to an occurrence number of said one or more abnormal types in a time period.

In one embodiment, the plurality of temperature grades are positively correlated with temperature.

In one embodiment, the groups of temperature data include a group of room temperature data, a group of evaporator temperature data, a group of condenser temperature data, a group of first tube temperature data, a group of second tube temperature data, and a group of ambient temperature data.

In one embodiment, the present disclosure provides an monitoring device of a cooling system, comprising: a plurality of temperature sensors, for generating groups of temperature data respectively; a monitoring module, for performing steps of: establishing an abnormality determination model according to predetermined abnormal data and predetermined abnormal types using deep learning; and determining one or more abnormal types and an abnormal prediction of the cooling system according to the groups of temperature data and the plurality of temperature sensors using the abnormality determination model.

In one embodiment, the monitoring module further performs a step of reestablishing the abnormality determination model according to the groups of temperature data and said one or more abnormal types using deep learning by the monitoring module.

In one embodiment, the step of determining one or more abnormal types and an abnormal prediction of the cooling system further includes: generating a plurality of temperature grades respectively according to the groups of temperature data using a grade calculation formula, determining said one or more abnormal types according to the plurality of temperature grades using the abnormality determination model, and determining the abnormal prediction according to an occurrence number of said one or more abnormal types in a time period.

In one embodiment, the plurality of temperature grades are positively corelated with temperature.

In one embodiment, the groups of temperature data include a group of room temperature data from a room temperature sensor, a group of evaporator temperature data from an evaporator temperature sensor, a group of condenser temperature data from a condenser temperature sensor, a group of first tube temperature data from a compressor suction temperature sensor disposed between an evaporator and a compressor, a group of second tube temperature data from a compressor discharge temperature sensor disposed between the compressor and a condenser, and a group of ambient temperature data from an ambient temperature sensor.

The monitoring method and monitoring device of the present disclosure perform professional data analysis for the temperature data of the cooling system and the temperature data in normal operation, and use analyzed data to predict the possible gradually-aged equipment elements or the possible abnormally operated equipment elements, thereby notifying customers of the problems from the cooling system. Therefore, maintenance personnel can understand the possible failure causes of the cooling system in advance, and prepare repair tools or elements that need to be replaced, to improve maintenance efficiency and extend the lifespan of the cooling system, thereby reducing user's property losses.

DETAILED DESCRIPTION OF PREFERRED EMBODIMENTS

In order to make the above and other objectives, features, and advantages of the present disclosure more obvious and understandable, the following specifically exemplifies the preferred embodiments of the present disclosure, combined with the accompanying drawings, and describe in detail as follows.

Figure 1:
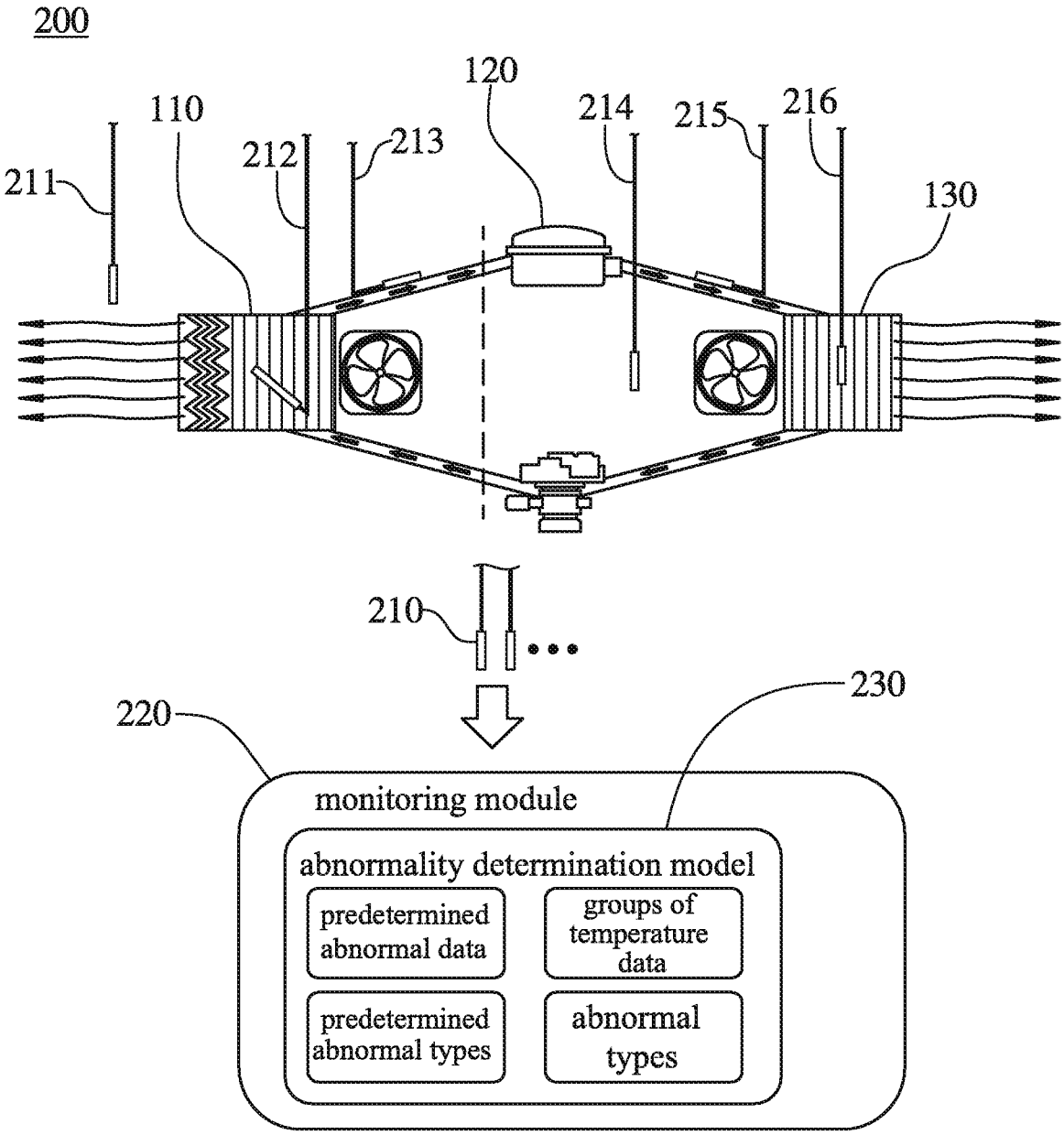
FIG. 1 is a schematic diagram of a monitoring device of a cooling system according to an embodiment of the present disclosure.

FIG. 1A is a schematic diagram of a cooling system according to an embodiment of the present disclosure. A monitoring device 200 of the cooling system includes a plurality of temperature sensors 210 and a monitoring module 220. In the embodiment of the present disclosure, the plurality of temperature sensors 210 include a room temperature sensor 211, an evaporator temperature sensor 212, a condenser temperature sensor 216, a compressor suction temperature sensor 213, and a compressor discharge temperature sensor 215 and the ambient temperature sensor 214. The compressor suction temperature sensor 213 is attached to a tube between an evaporator 110 and a compressor 120. The compressor discharge temperature sensor 215 is attached to a tube between the compressor 120 and a condenser 130. The room temperature sensor 211, the evaporator temperature sensor 212, the condenser temperature sensor 216, the compressor suction temperature sensor 213, the compressor discharge temperature sensor 215, and the ambient temperature sensor 214 respectively provide a group of room temperature data, a group of evaporator temperature data, a group of condenser temperature data, a group of first tube temperature data, a group of second tube temperature data, and a group of ambient temperature data.

In the embodiment of the present disclosure, the operation of the monitoring module 220 is as follows: establishing an abnormality determination model 230 according to predetermined abnormal data and predetermined abnormal types using deep learning, and determining one or more abnormal types and an abnormal prediction of the cooling system according to the groups of temperature data and the plurality of temperature sensors 210 using the abnormality determination model 230. The main function of the monitoring module 220 is to determine whether the status of each equipment element of the cooling system is abnormal (including aging) based on the temperature data from each temperature sensor, and even to predict abnormality. The monitoring module 220 has to firstly establish an abnormality determination standard, so the abnormal data of the equipment elements and the abnormal types of the equipment elements corresponding to the abnormal data are artificially determined, thereby establishing a function model. Then, an abnormality determination model 230 is trained according to the function model using a deep learning method. For example, Python can be used to write the function model. The historical data of abnormal data are input into the function model and the function model is worked in a specific model, such as Keras Sequential Model. By suitable model parameters, such as adopting seven layers including input, output, hidden and dropout layers, using activation functions of Relu and Softmax, using loss function of classification cross entropy, using optimizer of adaptive moment estimation (adam), the function model is enabled to learn. The abnormality determination model 230 with high accuracy is gradually trained after a lot of adjustments.

The monitoring module 220 having the abnormality determination model 230 can send groups of received temperature data to the abnormality determination model 230 for analysis. The current operating statuses or the abnormal types of the corresponding equipment elements are obtained by the analysis result of the temperature data and corresponding temperature sensor thereof, thereby obtaining a result indicating whether the equipment elements of the cooling system begin to age, or obtaining a trend diagram of aging possibility in the future. In one embodiment, groups of temperature data are input to the abnormality determination model 230 after undergoing data preprocessing steps, such as data smoothing processing, data change calculation, and change accumulation calculation, etc. The abnormal types may include room fan abnormal, condenser clogged, door not-closed, evaporator frosted and refrigerant leaked. In one embodiment, the analysis result of a single group of temperature data or multiple groups of temperature data may indicate one abnormal type of a specific equipment element. In another embodiment, the analysis result of a single group of temperature data may also indicate multiple abnormal types of multiple equipment elements.

In the embodiment of the present disclosure, the monitoring module 220 may further re-establish the abnormality determination model 230 by deep learning again according to groups of temperature data from groups of temperature sensors 210 of the cooling system and one or more abnormal types analyzed by the temperature sensors 210 in actual operation. The abnormality determination model 230 originally uses a function established by artificially abnormal data and abnormal types as a training reference. However, in order to further strengthen the abnormality determination model 230, when the monitoring device of the present disclosure is actually applied to monitor users' cooling systems, an updated abnormality determination model 230 can be obtained by using a deep learning method based on the temperature data and the abnormal types of each user's cooling system.

In the embodiment of the present disclosure, the monitoring module 220 further calculates temperature changes $\Delta_T = T_{i+1} - T_i$ according to the groups of temperature data and calculates temperature grades $T_0 = \Sigma_{i=0}^{n} \Delta_{T_i}$ accordingly. In one embodiment, taking the compressor as an example, the compressor 120 may shut down as its temperature reaches a set point, and turn on again due to insufficient temperature. The second tube temperature data of the compressor discharge temperature sensor 215 normally should be from a linear increase to a linear decrease, and then may be maintained at a specific temperature or room temperature for a while, and so on. The temperature changes of the compressor for each cycle are from fixed positive values to fixed negative values, and finally kept at zero. The temperature grades of the compressor are calculated by the previous values, and its normal range is around 0. If the temperature grades are gradually increased (0,1,2,3,4 . . . ), it means that the entire temperature of the compressor is gradually increased, and it is determined that the compressor may be operated abnormally. When the condenser is taken as an example, the temperature data of the condenser are analyzed. If the temperature grades are increased, the condenser may be a poor heat dissipation condition. Take the temperature data of the evaporator and the first tube temperature data of the compressor suction temperature sensor as example. If the temperature grades are decreased, it may be that frosted evaporator causes a temperature drop. Therefore, it is determined that the room may have heavy moisture or the evaporator may be incomplete defrosting.

The causal determination method and corelated data in the above example can be used as the learning parameters of the abnormality determination model 230. In addition, the monitoring module 220 can further train the abnormality determination model 230 to perform abnormality prediction. The abnormal statuses of the abovementioned equipment elements are collected statistically. The severity score of abnormality of the equipment elements is determined according to the level of the statistics, such that the user is notified in advance. For example, in a certain period of time, the occurrence number of the case where the temperature grades of the condenser are increased is counted, the number of the case where the temperature grades of the condenser are normal is counted, and the numbers are converted into a percentage value. Further, the severity score of abnormality of the condenser is determined based on the percentage value; moreover, the trend of abnormality possibility of the condenser in the future can be predicted.

Figure 2:
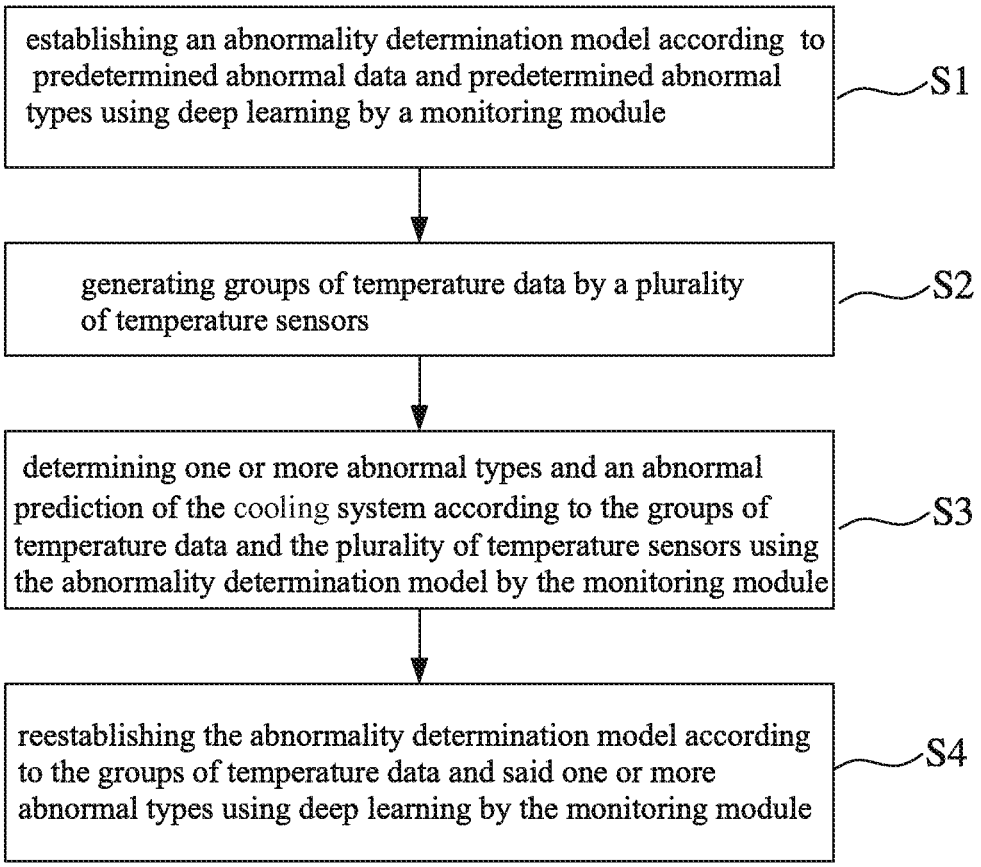
FIG. 2 is a flowchart of a monitoring method of a cooling system according to an embodiment of the present disclosure.

FIG. 2 is a flowchart of a monitoring method of a cooling system according to an embodiment of the present disclosure. The monitoring method includes step S1: establishing an abnormality determination model according to predetermined abnormal data and predetermined abnormal types using deep learning by a monitoring module. The monitoring module 220 has to firstly establish an abnormality determination standard, so the abnormal data of the equipment elements and the abnormal types of the equipment elements corresponding to the abnormal data are artificially determined, thereby establishing a function model. Then, an abnormality determination model 230 is trained according to the function model using a deep learning method.

Afterwards, the monitoring method proceeds to step S2: generating groups of temperature data by a plurality of temperature sensors. The monitoring method of the present disclosure is used to monitor equipment elements of a cooling system, and each equipment element is provided with a temperature sensor. These temperature sensors include a room temperature sensor 211, an evaporator temperature sensor 212, a condenser temperature sensor 216, a compressor suction temperature sensor 213, a compressor discharge temperature sensor 215 and the ambient temperature sensor 214. The compressor suction temperature sensor 213 is attached to a tube between an evaporator 110 and a compressor 120. The compressor discharge temperature sensor 215 is attached to a tube between the compressor 120 and a condenser 130. The room temperature sensor 211, the evaporator temperature sensor 212, the condenser temperature sensor 216, the compressor suction temperature sensor 213, the compressor discharge temperature sensor 215, and the ambient temperature sensor 214 respectively provide a group of room temperature data, a group of evaporator temperature data, a group of condenser temperature data, a group of first tube temperature data, a group of second tube temperature data, and a group of ambient temperature data.

After that, the monitoring method proceeds to step S3: determining one or more abnormal types and an abnormal prediction of the cooling system according to the groups of temperature data and the plurality of temperature sensors using the abnormality determination model by the monitoring module. The monitoring module 220 having the abnormality determination model 230 can analyze groups of received temperature data. The current operating statuses or the abnormal types of the corresponding equipment elements are obtained by the analysis result of the temperature data and the corresponding temperature sensor thereof, thereby obtaining a result indicating whether the equipment elements of the cooling system begin to age, or obtaining a trend diagram of aging possibility in the future.

In one embodiment, the monitoring method further proceeds to step S4: reestablishing the abnormality determination model according to the groups of temperature data and said one or more abnormal types using deep learning by the monitoring module. In order to further strengthen the abnormality determination model 230, when the monitoring device of the present disclosure is actually applied to monitor users' cooling systems, an updated abnormality determination model 230 can be obtained by using a deep learning method based on the temperature data and the abnormal types of each user's cooling system.

In an embodiment, the step S3 of the monitoring method further calculates temperature changes $\Delta_T = T_{i+1} - T_i$ according to the groups of temperature data and calculates temperature grades $T_0 = \Sigma_{i=0}^{n} \Delta_{T_i}$ accordingly. The operating conditions of the equipment elements to which the temperature sensors correspond, or whether the equipment elements are abnormal can be determined according to the increase and decrease of the temperature grades. These determination methods and corelated data can all be used as parameters learned by the abnormality determination model 230. In addition, the monitoring module 220 can further train the abnormality determination model 230 to perform abnormality prediction. The abnormal statuses of the abovementioned equipment elements are collected statistically. The severity score of abnormality of the equipment elements is determined according to the level of the statistics, such that the user is notified in advance.

Figure 3A:
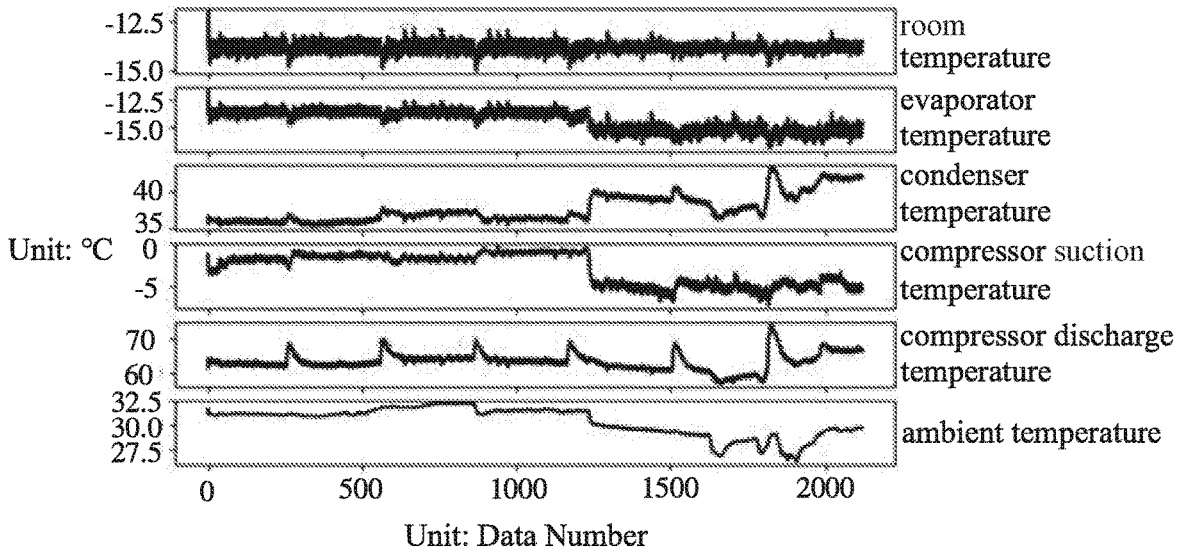
FIG. 3A is a graph of temperature data from a plurality of temperature sensors according to an embodiment of the present disclosure.
Figure 3B:
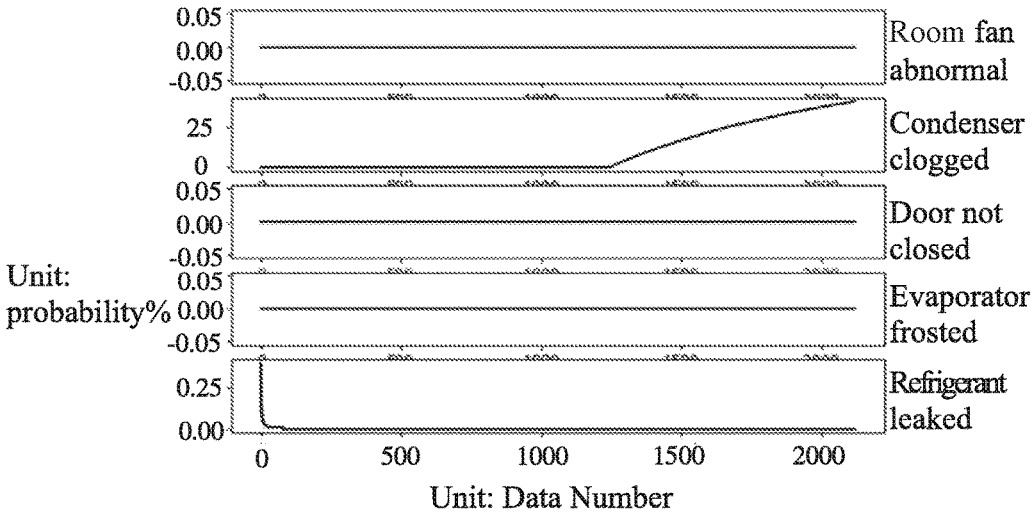
FIG. 3B is a trend diagram of abnormal prediction according to the temperature data of FIG. 3A.

FIG. 3A is a graph of temperature data from a plurality of temperature sensors according to an embodiment of the present disclosure. FIG. 3B is a trend diagram of abnormal predictions produced according to the temperature data of FIG. 3A. For example, FIGS. 3A-3B are examples of abnormal condenser operation. The temperature data in FIG. 3A includes a group of room temperature data, a group of evaporator temperature data, a group of condenser temperature data, a group of first tube temperature data (compressor suction temperature data), a group of second tube temperature data (compressor discharge temperature data), and a group of ambient temperature data. FIG. 3B is a trend prediction of abnormal types based on each temperature data in FIG. 3A, which includes room fan abnormal, condenser clogged, door not-closed, evaporator frosted, and refrigerant leaked. According to the temperature data of the condenser in FIG. 3A, it can be observed that the condenser is operating normally at the beginning, and the temperature is gradually increased after a period of time. Therefore, the monitoring device may determine that the condenser is clogged after analysis. Since the number of abnormality of the condenser analyzed from the temperature data during the operation of the latter half period is increased, a predictive trend graph of condenser clogged can be drawn by statistics.

Figure 4A:
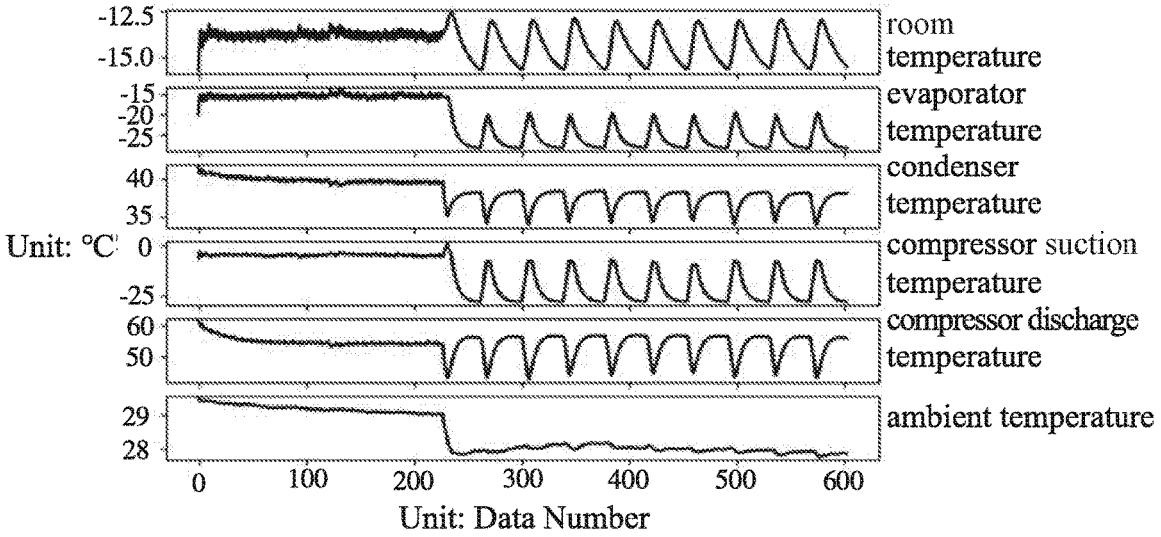
FIG. 4A is a graph of temperature data of a plurality of temperature sensors according to an embodiment of the present disclosure.
Figure 4B:
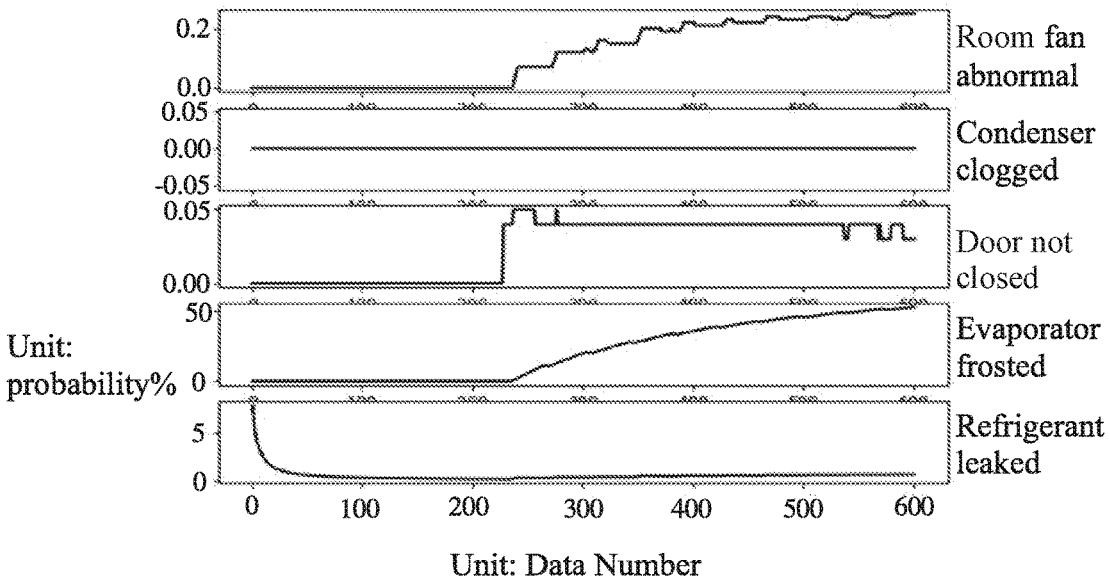
FIG. 4B is a trend diagram of abnormal prediction according to the temperature data of FIG. 4A.

FIG. 4A is a graph of temperature data of a plurality of temperature sensors according to an embodiment of the present disclosure. FIG. 4B is a trend diagram of abnormal predictions produced according to the temperature data of FIG. 4A. For example, FIGS. 4A-4B are examples of the evaporator being frosted. According to the temperature data of the condenser in FIG. 4A, it can be observed that the evaporator is operating normally at the beginning, and the temperature is fluctuated after a period of time. Therefore, the temperature data of the sensors of other equipment elements are also affected. The monitoring device determines that the evaporator is frosted after analysis. Although FIG. 4A looks likes that the temperature data of other temperature sensors shows the same fluctuation as the evaporator, the monitoring device further analyzes the level and the trend of abnormal possibility of each equipment element based on these data and other parameters.

Although the present disclosure has been disclosed in preferred embodiments, it is not intended to limit the present disclosure. Those who skilled in the art can make various changes and modifications without departing from the spirit and scope of the present disclosure. Therefore, the protection scope of the present disclosure shall be subject to those defined by the attached claim scope.

What is claimed is:

1. A monitoring method of a cooling system, comprising steps of:

S1: establishing an abnormality determination model according to predetermined abnormal data and predetermined abnormal types using deep learning by a monitoring module;

S2: generating groups of temperature data by a plurality of temperature sensors; and S3: determining one or more abnormal types and an abnormal prediction of the cooling system according to the groups of temperature data and the plurality of temperature sensors using the abnormality determination model by the monitoring module, wherein the step of S3 further includes: generating a plurality of temperature grades respectively according to the groups of temperature data using a grade calculation formula, determining said one or more abnormal types according to the plurality of temperature grades using the abnormality determination model, and determining the abnormal prediction according to an occurrence number of said one or more abnormal types in a time period; and wherein the step S3 of the monitoring method further calculates temperature changes $\Delta_T=T_{i+1}-T_i$ according to the groups of temperature data and calculates temperature grades $T_0=\Sigma_{i=0}^{n}\Delta_{T_i}$.

2. The monitoring method according to claim 1, further including a step of S4: reestablishing the abnormality determination model according to the groups of temperature data and said one or more abnormal types using deep learning by the monitoring module.

3. The monitoring method according to claim 1 wherein the plurality of temperature grades are positively correlated with temperature.

4. The monitoring method according to claim 1, wherein the groups of temperature data include a group of room temperature data, a group of evaporator temperature data, a group of condenser temperature data, a group of first tube temperature data, a group of second tube temperature data, and a group of ambient temperature data.

5. A monitoring device of a cooling system, comprising:

a plurality of temperature sensors, for generating groups of temperature data respectively;

a monitoring module, for performing steps of: establishing an abnormality determination model according to predetermined abnormal data and predetermined abnormal types using deep learning; and determining one or more abnormal types and an abnormal prediction of the cooling system according to the groups of temperature data and the plurality of temperature sensors using the abnormality determination model, wherein the step of determining one or more abnormal types and an abnormal prediction of the cooling system further includes: generating a plurality of temperature grades respectively according to the groups of temperature data using a grade calculation formula, determining said one or more abnormal types according to the plurality of temperature grades using the abnormality determination model, and determining the abnormal prediction according to an occurrence number of said one or more abnormal types in a time period; and wherein the monitoring module further calculates temperature changes $\Delta_T=T_{i+1}-T_i$ according to the groups of temperature data and calculates temperature grades $T_0=\Sigma_{i=0}^{n}\Delta_{T_i}$.

6. The monitoring device according to claim 5, wherein the monitoring module further performs a step of reestablishing the abnormality determination model according to the groups of temperature data and said one or more abnormal types using deep learning by the monitoring module.

7. The monitoring device according to claim 5, wherein the plurality of temperature grades are positively corelated with temperature.

8. The monitoring device according to claim 5, wherein the groups of temperature data include a group of room temperature data from a room temperature sensor, a group of evaporator temperature data from an evaporator temperature sensor, a group of condenser temperature data from a condenser temperature sensor, a group of first tube temperature data from a compressor suction temperature sensor disposed between an evaporator and a compressor, a group of second tube temperature data from a compressor discharge temperature sensor disposed between the compressor and a condenser, and a group of ambient temperature data from an ambient temperature sensor.

* * * * *